US007023321B2

(12) United States Patent
Brillon et al.

(10) Patent No.: US 7,023,321 B2
(45) Date of Patent: Apr. 4, 2006

(54) TRANSMITTING AND RECEIVING METHOD, ESPECIALLY FOR DETECTING AN ID TRANSMITTER

(75) Inventors: Alain Marc Bernard Brillon, Villeneuve Tolosane (FR); Klaus Hofbeck, Neumarkt (DE); Johannes Ilg, Regensburg (DE); Wolfgang Piesch, Regenstauf (DE)

(73) Assignee: Siemens Aktiengesellschaft, Munich (DE)

( * ) Notice: Subject to any disclaimer, the term of this patent is extended or adjusted under 35 U.S.C. 154(b) by 216 days.

(21) Appl. No.: 10/237,477

(22) Filed: Sep. 9, 2002

(65) Prior Publication Data

US 2003/0016140 A1 Jan. 23, 2003

Related U.S. Application Data

(63) Continuation of application No. PCT/DE01/00870, filed on Mar. 7, 2001.

(30) Foreign Application Priority Data

Sep. 3, 2000 (DE) ..... 100 11 509

(51) Int. Cl.
*G08C 19/00* (2006.01)

(52) U.S. Cl. ..... 340/5.61; 340/825.72; 307/10.2; 180/287

(58) Field of Classification Search ..... 340/5.72, 340/5.61, 539, 825.69, 825.72; 70/278; 307/10.2, 307/10.1; 180/278, 287; 455/67.11, 424, 455/561, 115, 226.2, 562
See application file for complete search history.

(56) References Cited

U.S. PATENT DOCUMENTS

| | | | | |
|---|---|---|---|---|
| 4,054,837 | A | 10/1977 | Hibbs, Jr. et al. | 325/21 |
| 4,723,121 | A | 2/1988 | van den Boom et al. | 340/825.31 |
| 5,001,486 | A | 3/1991 | Bächtiger | 342/42 |
| 5,051,741 | A | 9/1991 | Wesby | 340/825.49 |
| 5,307,193 | A | 4/1994 | VanZeeland et al. | 359/145 |
| 5,463,374 | A | 10/1995 | Mendez et al. | 340/442 |
| 5,649,295 | A | 7/1997 | Shober et al. | 455/38.2 |
| 5,670,933 | A | 9/1997 | Hayashi | 340/426 |
| 5,736,793 | A | 4/1998 | Jahrsetz et al. | 307/10.1 |
| 5,815,108 | A | 9/1998 | Terk | 341/176 |
| 5,838,255 | A | 11/1998 | Di Croce | 340/825.69 |
| 5,917,449 | A | 6/1999 | Sanderford et al. | 342/457 |
| 5,956,259 | A | 9/1999 | Hartsell, Jr. et al. | 364/528.37 |
| 6,046,683 | A | 4/2000 | Pidwerbetsky et al. | 340/825.54 |
| 6,064,320 | A | 5/2000 | d'Hont et al. | 340/933 |

(Continued)

FOREIGN PATENT DOCUMENTS

DE 2537421 7/1976

(Continued)

*Primary Examiner*—Michael Horabik
*Assistant Examiner*—Matsuichiro Shimizu
(74) *Attorney, Agent, or Firm*—Baker Botts L.L.P.

(57) ABSTRACT

In a transmitting and receiving method, a request signal is transmitted between a first and an additional transmitting and receiving device by means of a bi-directional first communications path. According to the request signal, a second communications path is established for a predetermined time interval and the receiving power in the additional transmitting and receiving device is measured by means of a measuring device.

12 Claims, 1 Drawing Sheet

U.S. PATENT DOCUMENTS

| | | | | |
|---|---|---|---|---|
| 6,078,252 | A | 6/2000 | Kulczycki et al. | 340/425.5 |
| 6,101,428 | A | 8/2000 | Snyder | 701/2 |
| 6,107,910 | A | 8/2000 | Nysen | 340/10.1 |
| 6,179,273 | B1 | 1/2001 | Edmunds, III et al. | 256/13.1 |
| 6,236,333 | B1 | 5/2001 | King | 340/825.31 |
| 6,259,991 | B1 | 7/2001 | Nysen | 701/300 |
| 6,323,566 | B1 * | 11/2001 | Meier | 307/10.2 |
| 6,353,776 | B1 | 3/2002 | Röhrl et al. | 701/1 |
| 6,380,845 | B1 | 4/2002 | Tuttle | 340/10.4 |
| 6,414,586 | B1 | 7/2002 | Yoshizawa | 340/5.2 |
| 6,414,592 | B1 | 7/2002 | Dixit et al. | 340/447 |
| 6,414,626 | B1 | 7/2002 | Greef et al. | 342/127 |
| 6,424,056 | B1 | 7/2002 | Irvin | 307/10.1 |
| 6,429,768 | B1 | 8/2002 | Flick | 340/5.2 |
| 6,438,466 | B1 | 8/2002 | Voigtlaender et al. | 701/1 |
| 6,438,467 | B1 | 8/2002 | Pacsai | 701/2 |
| 6,448,892 | B1 | 9/2002 | Delaporte | 340/442 |
| 6,480,098 | B1 | 11/2002 | Flick | 340/7.2 |
| 6,538,560 | B1 * | 3/2003 | Stobbe et al. | 340/5.72 |
| 6,597,284 | B1 | 7/2003 | Juzswik | 340/442 |
| 6,617,975 | B1 | 9/2003 | Burgess | 340/815.47 |
| 6,693,581 | B1 | 2/2004 | Gottwald et al. | 342/70 |
| 6,697,616 | B1 * | 2/2004 | Heinz et al. | 455/424 |
| 6,809,629 | B1 | 10/2004 | Heide et al. | 340/5.61 |
| 2002/0008615 | A1 | 1/2002 | Heide et al. | 340/426 |

FOREIGN PATENT DOCUMENTS

| | | |
|---|---|---|
| DE | 3838657 | 5/1990 |
| DE | 9410369 | 11/1994 |
| DE | 43 29 697 A | 3/1995 |
| DE | 29607877 | 9/1996 |
| DE | 4409167 | 3/1998 |
| DE | 197 52 029 A1 | 6/1999 |
| DE | 19825702 | 12/1999 |
| DE | 19927319 | 12/2000 |
| DE | 19957536 | 6/2001 |
| DE | 10038297 | 3/2002 |
| EP | 0 848 123 A2 | 6/1998 |
| FR | 2749607 | 12/1997 |
| GB | 2179751 | 3/1987 |
| JP | 7057792 | 3/1995 |
| JP | 9312190 | 12/1997 |
| WO | WO 99 59284 | 11/1999 |

* cited by examiner

TRANSMITTING AND RECEIVING METHOD, ESPECIALLY FOR DETECTING AN ID TRANSMITTER

CROSS REFERENCE TO RELATED APPLICATION

This application is a continuation of copending International Application No. PCT/DE/01/00870 filed Mar. 7, 2001, which designates the United States, and claims priority to German application number 10011509.8 filed Mar. 9, 2000.

BACKGROUND OF THE INVENTION

The invention relates to a method for transmitting and receiving signals between at least one first transmitting and receiving device and at least one further transmitting and receiving device, in particular for unlocking and/or locking a vehicle, as well as to transmitting and receiving devices and an arrangement comprising such devices for this purpose.

Methods such as these as well as transmitting and receiving devices are used, for example, in vehicle technology in order to allow the vehicle or the vehicle doors to be unlocked and/or the antitheft device to be deactivated in a manner which is as convenient as possible for an operator.

Passive access systems are being increasingly used for this purpose, in which an operator carries an ID transmitter with him which, in contrast to active systems, need not be operated by means of a button or the like, but communicates automatically with a corresponding base station which is located in the vehicle, as soon as the distance between the ID transmitter and the vehicle or the base station falls below a specific value.

Active and, in particular, passive, electronic key-operated systems such as these, which are generally based on the use of radio, are subject to stringent security requirements with regard to unauthorized access, with a power consumption which is as low as possible generally being desirable, since the power sources for the ID transmitter and/or base station are generally autonomous, in order to ensure operation even over a lengthy time period.

SUMMARY OF THE INVENTION

The present invention is therefore based on the object of providing a method for transmitting and receiving signals between at least one first transmitting and receiving device and at least one further transmitting and receiving device, as well as a transmitting and receiving device and an arrangement for this purpose, which ensure a high level of security with regard to unauthorized access, while at the same time having a power consumption which is as low as possible.

According to the invention, this object is achieved by a method for transmitting and receiving signals between at least one first transmitting and receiving device and at least one further transmitting and receiving device, in particular for unlocking and/or locking a vehicle, a) with the presence of the further transmitting and receiving device being monitored by the first transmitting and receiving device by means of a bidirectional first communication path, b) the first transmitting and receiving device transmitting a request signal via the first communication path on detection of the further transmitting and receiving device of this further transmitting and receiving device, c) a second communication path being set up for a predetermined time interval between the first and the further transmitting and receiving device as a function of this request signal, and d) the reception power level in the further transmitting and receiving devices being measured by means of a measurement device.

According to an embodiment of the present invention a transmitting and receiving device has a first transmitting and a first receiving unit for a first communication path with at least one further transmitting and receiving device, wherein the transmitting and receiving device has at least one further transmitting and/or receiving unit which can be switched on and off and has a measurement device in order to measure the reception power of a further transmitting and receiving device.

An arrangement according to the present invention comprises at least a first transmitting and a first receiving unit for a first communication path and at least one further transmitting and receiving device which can be switched off.

The setting up of at least one further communication path for only a predetermined time interval as a function of a request signal which is transmitted via a first communication path makes undesirable recording or monitoring of the communication more difficult, since communication such as this is not expected based on the prior art.

The method according to the invention now makes it possible to set up a second communication path which, although its power consumption is higher, nevertheless offers a high level of protection for this purpose against unauthorized access by means of direct or indirect imitation of an access code. The high power consumption advantageously occurs only during a predetermined, short time window, which is in the microsecond range, so that the overall power consumption resulting from this very short-term greater power consumption, which occurs only when a valid request signal is received, increases only insignificantly.

The second communication path may accordingly be set up both bidirectionally and unidirectionally, in which case, since the time interval is short, it is also possible to use very high power-consumption transmission methods, such as very high frequencies, high amplitudes at the transmitter end or very sensitive, high-power receivers which are designed, for example, using measurement amplifier units.

It is particularly advantageous for the second communication path to be set up as an LF system, in which the signals are transmitted essentially by means of magnetically inductive coupling. Since a base station which is located in a vehicle is normally intended to cover a certain area, for example with a diameter of 1 to 3 meters, in which an ID transmitter can be detected, systems such as these have a very high power consumption.

In order to set up a functioning communication path at least unidirectionally, appropriate antennas, for example frame antennas, can be used at the transmitter end in the base station, and may be operated at high power levels, via power amplifiers.

At the receiving end in the ID transmitter, the receiver can be made more sensitive by means of a measurement amplifier unit, thus resulting in an increase in range in conjunction with normal LF transmitters (without power amplification) and, in particular, making it possible to achieve a greater range by means of the amplified-power LF transmitters mentioned above.

In contrast to systems (which are generally in higher frequency bands) with a strong electrical field component, magnetically inductive coupling is advantageously not influenced or interfered with by organic material and reflections. The predetermined time interval in a very short time window furthermore means that interference outside this time window is ignored, so that these measures considerably improve the interference immunity of the overall system. Owing to the lack of shielding and reflection of the predominant magnetic field component, it is also possible to set an accurate range irrespective of local characteristics and objects or people in this area, so that it is advantageously possible to avoid anomalous propagation and correspondingly undesirable initiation effects.

If the LF communication path is made possible with an appropriate range by using a measurement amplifier unit at the receiver end, then it is also possible to transmit at a lower power level at the transmitter end and to reduce the power consumption at the transmitter end, so that the power source in the vehicle, for example the battery, is loaded to a lesser extent. A reduced transmitter power also results in a reduced radiation load and hence in reduced radiated interference affecting other components, while at the same time avoiding any health risks.

According to the method on which the invention is based, the reception power in the further transmitting and receiving device, that is to say for example an ID transmitter, is measured by means of a measurement device. Various embodiments are feasible for this purpose, for example in the form of one or more threshold values which, when reached, result in actions such as indication of this threshold value, storage of the threshold value, evaluation of a number of received threshold values or else the transmission of such measurement results or in evaluations to the at least one first transmitting and receiving device, for example the base station in a vehicle.

The corresponding evaluations and actions as a function of this, such as the locking or unlocking of the doors, the activation or deactivation of the antitheft device, can in consequence also be carried out by the base station, by means of appropriate control units.

The start of the predetermined time interval need not, of course, coincide with the time at which a request signal is correctly received, but may also be offset in time by a predetermined time interval. In this case, it is also feasible to integrate a future time for the start of the time interval as information in the request signal. The duration of the predetermined time interval may be predetermined or adjustable via appropriate electronic devices, for example an RF element or an appropriate digital counter in the ID transmitter, or may likewise be included as information in the request signal.

The method according to the invention is particularly advantageous if it carried out more than once using different parameters, and corresponding measurement results are determined. By way of example, the transmission power and/or the receiver sensitivity may be changed, and/or may be varied by physically different transmission areas, for example by means of a number of antennas or combination antennas, which are arranged at physically different locations and have different emission angles.

The corresponding measurement results may then be transmitted individually to the other transmitting and receiving device, or may be collected in advance and transmitted in a block. In this case, it is also feasible for more detailed evaluation of these measurement results not only to be carried out in the at least first transmitting and receiving device, but also to be carried out in the further transmitting and receiving device, before transmission, as a final or intermediate result.

In a further advantageous refinement of the invention, field distortion and calibration values for the transmitting and receiving device may be used in order to evaluate the received field strength values as exactly as possible, by means of a table which is stored, for example, as a data item in an evaluation unit.

In contrast to the second, high power consumption, communication path, which is set up via a transmitting and/or receiving unit, which can be switched on, between at least two transmitting and receiving devices, the first communication path is advantageously set up as a very low-power communication path. In the case of conventional RF systems, this is the case in the MHz band, for example at 433 MHz or 867 MHz, which can advantageously be implemented in a highly space-saving manner and highly cost-effectively since this is in widespread use.

Further advantageous refinements of the invention may be found in the dependent claims.

BRIEF DESCRIPTION OF THE DRAWINGS

The invention will be explained in more detail in the following text with reference to an exemplary embodiment which is illustrated in the drawing. In the drawing.

DETAILED DESCRIPTION OF THE PREFERRED EMBODIMENTS

Figure 1:
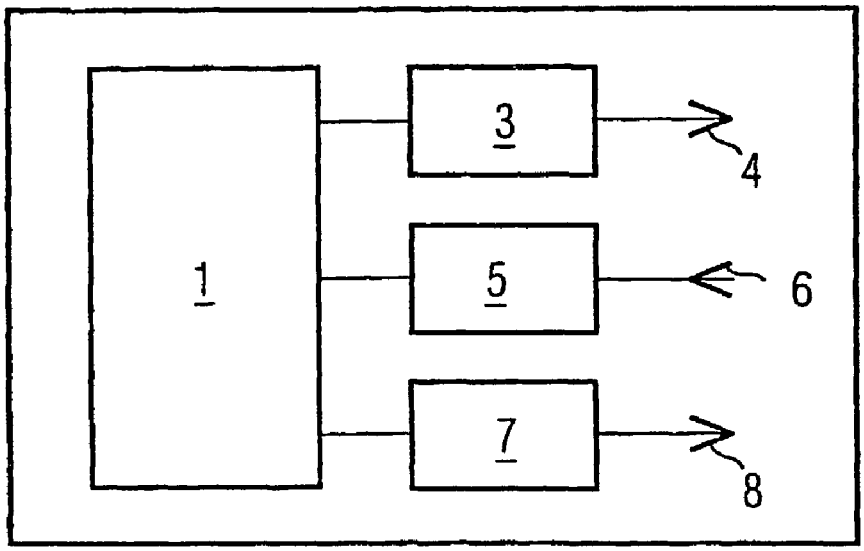
FIG. 1 shows a schematic block diagram of a base station located in a motor vehicle.

The base station which is illustrated in FIG. 1 has a control unit 1, a transmitting unit 3, a receiving unit 5 and an LF transmitter, for example a ping generator 7. The transmitting unit 3 is in this case connected to a schematically illustrated antenna 4, in the same way that the receiver unit 5 is connected to its antenna 6. It is, of course, feasible for the transmitting unit 3 and receiving unit 5, which are illustrated separately here, to be in the form of a combined transmitting and receiving unit, which is either connected to a transmitting antenna 4 and to a receiving antenna 6, or has a single antenna which acts both as a transmitting antenna and as a receiving antenna. As a further transmitting unit, the base station has a so-called ping generator 7 which transmits a very low-frequency field, in the LF band, for example at 100 to 300 KHz and with a predominantly magnetic field component, via its antenna 8, for example in the form of a frame antenna.

Figure 2:
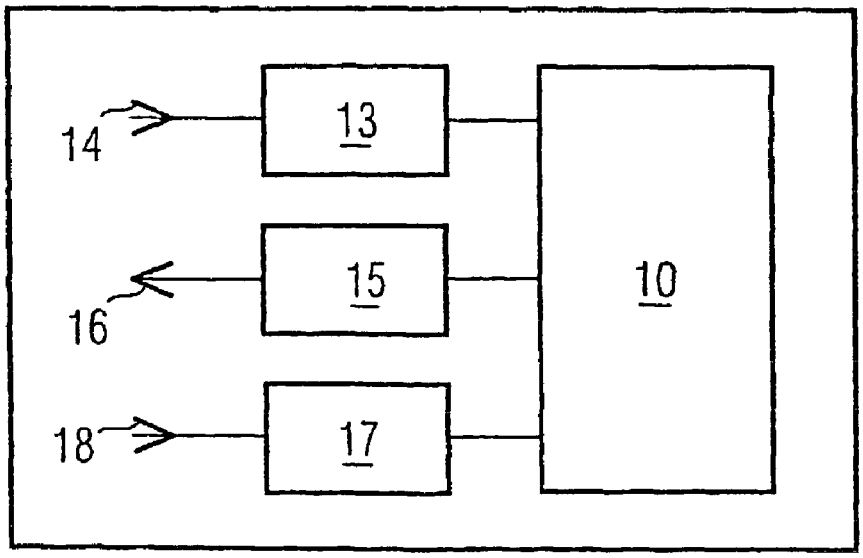
FIG. 2 shows a schematic block diagram of an ID transmitter.

In the same way as the base station, the ID transmitter which is illustrated in FIG. 2 has a control unit 10, a receiver unit 13 and a transmitting unit 15, which are each connected to their antennas (receiving antenna 14 and transmitting antenna 16). In contrast to the base station, the ID transmitter has, instead of an LF transmitter, an LF receiver 17, in the form of a ping receiver, which can produce magnetically inductive coupling via its receiving antenna 18 in conjunction with the ping generator 7 and the transmitting antenna 8 of the base station.

As described above for the base station, it is also possible, rather than using a separate transmitting unit 15 and receiving unit 18, to use a combined transmitting and receiving unit with one transmitting and receiving antenna or separate transmitting and receiving antennas 14 and 16.

When an ID transmitter is located in the area of the base station, then bidirectional communication (first communication path) takes place via the transmitter 3, 15 and receiver units 5, 13, for example in the low power consumption RF band, in which case, as in conventional systems, an ID transmitter can be detected when it is within a certain vicinity.

In contrast to this result, which is relatively uncertain as a result of anomalous propagation, reflections, shielding or even unauthorized access actions, the method according to the invention means that the detection and, as a function of this, an appropriate action such as locking/unlocking of the doors, activation/deactivation of the antitheft device take place only when a further result has been successfully transmitted and appropriately evaluated.

For this purpose, on detection of an ID transmitter by means of the first communication path, the base station uses this first communication path to send a request signal, which signals to the ID transmitter that a signal will be transmitted at a specific time within a short time window via a second communication path.

An LF path is in this case chosen as the communication path, which advantageously allows magnetically inductive coupling, which is subject to only a lesser extent, if at all, to the above mentioned disadvantages, such as shielding, reflection and unauthorized intervention.

In the simplest embodiment as illustrated, the base station has only one ping generator 7 and the ID transmitter has only one ping receiver 17, so that this further communication path is only of a unidirectional nature. At the signaled time, the base station switches the ping generator 7 on via its control unit 1, and the ping generator 7 emits the magnetically inductive signal via its frame antenna 8.

Furthermore, in the ID transmitter, the ping receiver 17 is switched on by means of the control unit 10 at the signaled time, likewise for a short time interval, which is advantageously essentially at the same time, and, by means of its antenna 18, receives the signal transmitted from the ping generator 7 in the base station.

In order to keep transmission power of the ping generator in the base station as low as possible, so that other components are advantageously subject to less radiated interference and so that low-cost components can be used, the ID transmitter has a measurement amplifier, which is not shown in any greater detail in FIG. 2, for correct reception of such a signal at a reduced transmission power.

This measurement amplifier, which may be integrated in the ping receiver 17 or in the control unit 10 or may be arranged as an autonomous unit in the path from the frame antenna 18 to the control unit 10, appropriately increases the sensitivity of the ping receiver 17, in order to allow this magnetically inductive communication path to be set up correctly within a desired area, for example within several meters, and in particular within one to three meters.

The reception power level is in this case determined in the ID transmitter by means of a measurement unit, which is not illustrated in any greater detail, for example in the form of a threshold value or threshold values which can be reached in different ways. At the end of the time interval, the communication path is interrupted both in the base station and in the ID transmitter, by switching off the ping generator 7 and the ping receiver 17, and/or the measurement amplifier which is not illustrated.

The determined measurement result is then signaled by the ID transmitter via the first communication path, that is to say the transmitter 15, the receiver 5 of the base station, and is used by this base station, if received correctly, to unlock the doors and/or deactivate the antitheft devices.

Conversely, it is feasible to allow the opposite actions to be carried out, that is to say the locking of the doors and activation of the antitheft device, either when the doors are actually closed or only when a failed attempt is made to use the second communication path.

The capabilities of the system can be further enhanced if the steps which have been mentioned comprising the "request signal", and "transmission of a signal via at least one further communication path" and "measurement of the reception power level" are carried out more than once, since, for example, this allows the speed of approach to be determined via one and the same antenna 8 on the basis of different results.

It is also feasible to fit a number of frame antennas 8 in the vehicle so that transmission fields are transmitted via one or more ping generators 7, which are connected to these frame antennas 8, from different locations in the vehicle, for example the left-hand door, right-hand door, tailgate etc., and for the position of the ID transmitter, that is to say the direction with respect to the base station, to be detected as a function of the reception power levels detected in the ID transmitter, which are either signaled individually to the base station as the result or are collected in advance in the ID transmitter where they may be subjected to partial or full evaluation, or may be subjected to such evaluation in the base station.

This not only avoids dead angles, but also allows different actions to be carried out, such as unlocking of the left-hand door when approaching from the left, unlocking of the right-hand door when approaching from the right, unlocking of the tailgate or of the trunk on approaching from the rear, etc., to be carried out as a function of the direction and/or of the above-mentioned speed of approach.

Although the described exemplary embodiment has been used to explain the method according to the invention on the basis of a passive access system for a motor vehicle, it can, of course, also be used for an active access system, that is to say for setting up the first communication path on the basis of operation of a button or the like in the ID transmitter. Furthermore, the method according to the invention as well as an arrangement of the transmitting and receiving devices according to the invention for carrying out such a method are not restricted to vehicle technology, but may be used in many fields, such as building technology, monitoring technology, counting systems etc.

By way of example, access controls such as these may also be used for house doors, garage doors etc. On the other hand, instead of being used for access control, the invention can also be used for secure detection of a transmitting and receiving device for monitoring moving objects, such as people, where such a moving object is located, or how often it passes specific positions (counting systems).

The invention claimed is:

1. A method for transmitting and receiving signals between at least one first transmitting and receiving device and at least one further transmitting and receiving device, in particular for unlocking and/or locking a vehicle, a) monitoring with the first transmitting and receiving device, via a first communication path of a given frequency, for the presence of the second transmitting and receiving device, b) transmitting a request signal from the first transmitting and receiving device via the first communication path on detection of the second transmitting and receiving device, c) setting up a second communication path of a lower frequency than the frequency of the first communication path for a predetermined time interval between the first and the second transmitting and receiving devices as a function of the request signal, and d) measuring the reception power level in the second transmitting and receiving device by means of a measurement device.

2. A method as claimed in claim 1, wherein the measurement result is transmitted via the first communication path to the first transmitting and receiving device.

3. A method as claimed in claim 1, wherein the first transmitting and receiving device or the second transmitting and receiving device evaluates the measurement result by means of an evaluation unit.

4. A method as claimed in claim 1, wherein the first and second communication paths use high and low frequency bands, respectively.

5. A method as claimed in claim 1, wherein a measurement amplifier unit is connected in the second transmitting and receiving device for setting up the second communication path.

6. A method as claimed in claim 1, wherein the start and duration of the predetermined time interval are derived from information content of the request signal.

7. A method as claimed in claim 1, wherein the second communication path uses LF band.

8. A method as claimed in claim 1, wherein the second communication path is unidirectional.

9. A method as claimed in claim 1, wherein, in order to identify the position of the second transmitting and receiving device, steps a) to d) are repeated a number of times using a different transmission power.

10. A method as claimed in claim 9, wherein the measurement results are evaluated in the first transmitting and receiving device by means of an evaluation unit.

11. A method as claimed in claim 10, wherein the evaluation unit evaluates the measurement results for detection of the second transmitting and receiving device by means of a fixed table.

12. A method for transmitting and receiving signals between a first transmitting and receiving device and a second transmitting and receiving device for unlocking and/or locking a lock, said method comprising:

a) monitoring with the first transmitting and receiving device, via a first communication path, for the presence of the second transmitting and receiving device, b) transmitting a request signal from the first transmitting and receiving device via the first communication path upon detection of the second transmitting and receiving device, c) setting up a second communication path for a predetermined time interval between the first and the second transmitting and receiving devices as a function of the request signal, the start and duration of said predetermined time interval derived from information content of said request signal, and d) measuring the reception power level in the second transmitting and receiving device.

* * * * *

UNITED STATES PATENT AND TRADEMARK OFFICE

CERTIFICATE OF CORRECTION

PATENT NO. : 7,023,321 B2
APPLICATION NO. : 10/237477
DATED : April 4, 2006
INVENTOR(S) : Alain Marc Bernard Brillion et al It is certified that error appears in the above-identified patent and that said Letters Patent is hereby corrected as shown below:

Title page [30] Foreign Application Priority Data: Please correct the Foreign Application Priority Data by deleting "Sep. 3, 2000" and replacing with --March 9, 2000--.

March 9, 2000 (DE) 201 20 252

Signed and Sealed this

Twenty-second Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,023,321 B2
APPLICATION NO. : 10/237477
DATED : April 4, 2006
INVENTOR(S) : Alain Marc Bernard Brillon et al.

It is certified that error appears in the above-identified patent and that said Letters Patent is hereby corrected as shown below:

Face page [30] Foreign Application Priority Data: Please correct the Foreign Application Priority Data by deleting "Sep. 3, 2000" and replacing with --March 9, 2000--. Also, please correct the Foreign Application Priority Data by deleting "201 20 252" and replacing with --100 11 509--.

March 9, 2000 (DE) 100 11 509

Signed and Sealed this

Thirtieth Day of January, 2007

JON W. DUDAS
*Director of the United States Patent and Trademark Office*